US010525606B2

(12) United States Patent
Cheng

(10) Patent No.: US 10,525,606 B2
(45) Date of Patent: Jan. 7, 2020

(54) KNIFE STRUCTURE ALLOWING RAPID AND SAFE REPLACEMENT, AND SECURE POSITIONING, OF BLADE, AND KNIFE HANDLE STRUCTURE THEREOF

(71) Applicant: KANTAS PRODUCTS CO., LTD., Taipei (TW)

(72) Inventor: Yang-Fu Cheng, Taipei (TW)

(73) Assignee: KANTAS PRODUCTS CO., LTD., Taipei (TW)

( * ) Notice: Subject to any disclaimer, the term of this patent is extended or adjusted under 35 U.S.C. 154(b) by 0 days.

(21) Appl. No.: 16/137,636

(22) Filed: Sep. 21, 2018

(65) Prior Publication Data

US 2019/0217489 A1 Jul. 18, 2019

(30) Foreign Application Priority Data

Jan. 18, 2018 (TW) ..... 107200897 U

(51) Int. Cl.
*B26B 5/00* (2006.01)

(52) U.S. Cl.
CPC ..... *B26B 5/00* (2013.01)

(58) Field of Classification Search
CPC ..... B26B 5/00
USPC ..... 30/156, 157
See application file for complete search history.

(56) References Cited

U.S. PATENT DOCUMENTS 9,763,693 B2 * 9/2017 Kanigan ..... A61B 17/3213
2014/0366387 A1 * 12/2014 Schuft ..... A22B 5/168 30/293
2017/0059863 A1 * 3/2017 Kasazumi ..... B60K 35/00
2017/0151682 A1 * 6/2017 Cheng ..... B26B 5/00

* cited by examiner

*Primary Examiner* — Kenneth E Peterson
*Assistant Examiner* — Liang Dong
(74) *Attorney, Agent, or Firm* — Bacon & Thomas, PLLC

(57) ABSTRACT

A knife structure allowing rapid and safe replacement, and secure positioning of, a blade disposed along with its handle structure; wherein the knife structure includes the blade, an engaging and pushing plate, and an engaging and positioning base; a first connecting member is fixed to the engaging and pushing plate and is movably engaged in the blade and the engaging and positioning base; an engaging block is fixed to the engaging and positioning base and is movably engaged in the blade and the engaging and pushing plate; and the first connecting member is locked to the engaging and positioning base upon assembly of the knife structure. Once unlocked via a pushing and unlocking key, the first connecting member can be used to push the engaging and pushing plate and the blade simultaneously, allowing the blade to be pushed out of engagement with the engaging block and then detached for replacement.

10 Claims, 8 Drawing Sheets

KNIFE STRUCTURE ALLOWING RAPID AND SAFE REPLACEMENT, AND SECURE POSITIONING, OF BLADE, AND KNIFE HANDLE STRUCTURE THEREOF

FIELD OF THE INVENTION

The present invention relates to knifes and more particularly to a knife structure in which a blade can be rapidly detached for replacement by first pressing a pushing and unlocking key to disengage an engaging and pushing plate, on which the blade is provided, from an engaging and positioning base, and then pushing the blade out of engagement with the engaging block on the engaging and pushing plate.

BACKGROUND OF THE INVENTION

Different types of cutting edges have their respective pros and cons. To meet different cutting needs, therefore, one may have to carry several knives with them at the same time, but this will increase the purchase cost incurred by the user and the trouble the user must undergo while carrying the knives around or performing maintenance work on the knives. As a solution, the concept of "replaceable" structures has been applied to common knife products, resulting in knife structures with replaceable blades.

While such a knife structure does allow its user to purchase different blades (e.g., those with a plain edge, a partly serrated or combo edge, or a fully serrated edge) as needed, and mount whichever blade that is called for by the situation at hand to the handle, the applicant has found a common drawback among those knife structures: a user trying to mount or replace a blade not only is required to use both hands, but also must grip a portion of the blade that is close to the front end (i.e., the tip) of the blade with one hand and apply a certain amount of force to, and thereby deform, the blade so that the blade can be engaged in or separated from a groove in the handle in order to be mounted to or detached from the handle.

As the portion of the blade that the user has to grip (i.e., a portion close to the front end, or tip, of the blade) does not have a large area, and the cutting edge of the blade can be very sharp, it is extremely difficult, if not dangerous or unsafe, for the user to mount or detach the blade by gripping the blade and applying thereto a force large enough to deform the blade. This explains why most users may have problem mounting a replaceable blade to its handle or detaching the blade from the handle in a safe and effortless manner. The issue to be addressed by the present invention is to provide an effective solution to the foregoing drawback of the conventional knives.

BRIEF SUMMARY OF THE INVENTION

In view of the fact that one who has different cutting needs may have to buy knifes with different types of cutting edges and carry the knives with them, which can be burdensome both financially and physically, the inventor of the present invention incorporated years of practical experience in the development of knife-related products into extensive research and numerous tests and finally succeeded in developing a knife structure that allows rapid and safe replacement, and secure positioning, of a blade. The invention is intended to solve the problem of the conventional knives (including surgical knives) that their blades cannot be replaced safely and conveniently.

One objective of the present invention is to provide a knife structure that allows its blade to be rapidly and safely replaced and securely positioned. The knife structure includes, sequentially in a top-to-bottom direction, a blade, an engaging and pushing plate, and an engaging and positioning base. A first connecting member is fixed to the engaging and pushing plate and is movably engaged in the blade and the engaging and positioning base. An engaging block is fixed to the engaging and positioning base and is movably engaged in the blade and the engaging and pushing plate. Once the blade, the engaging and pushing plate, and the engaging and positioning base are put together, the first connecting member is locked to the engaging and positioning base. When a user subsequently presses a pushing and unlocking key, the first connecting member is driven out of the locked state and can be used to push the engaging and pushing plate and the blade at the same time. After that, the user can disengage the blade from the engaging block simply by pushing the blade. Thus, the user only has to grip the blade by its two vertically opposite sides with the fingertips or pulps of two fingers (e.g., a thumb and the corresponding index finger) and put the blade on the engaging and pushing plate and the engaging and positioning base, and the blade can be brought into the locked state without the user touching the blade.

BRIEF DESCRIPTION OF THE SEVERAL VIEWS OF THE DRAWINGS

The structural features, operation, and technical appeal of the present invention can be better understood by referring to the following detailed description of some illustrative embodiments in conjunction with the accompanying drawings, in which.

DETAILED DESCRIPTION OF THE INVENTION

Figure 1:
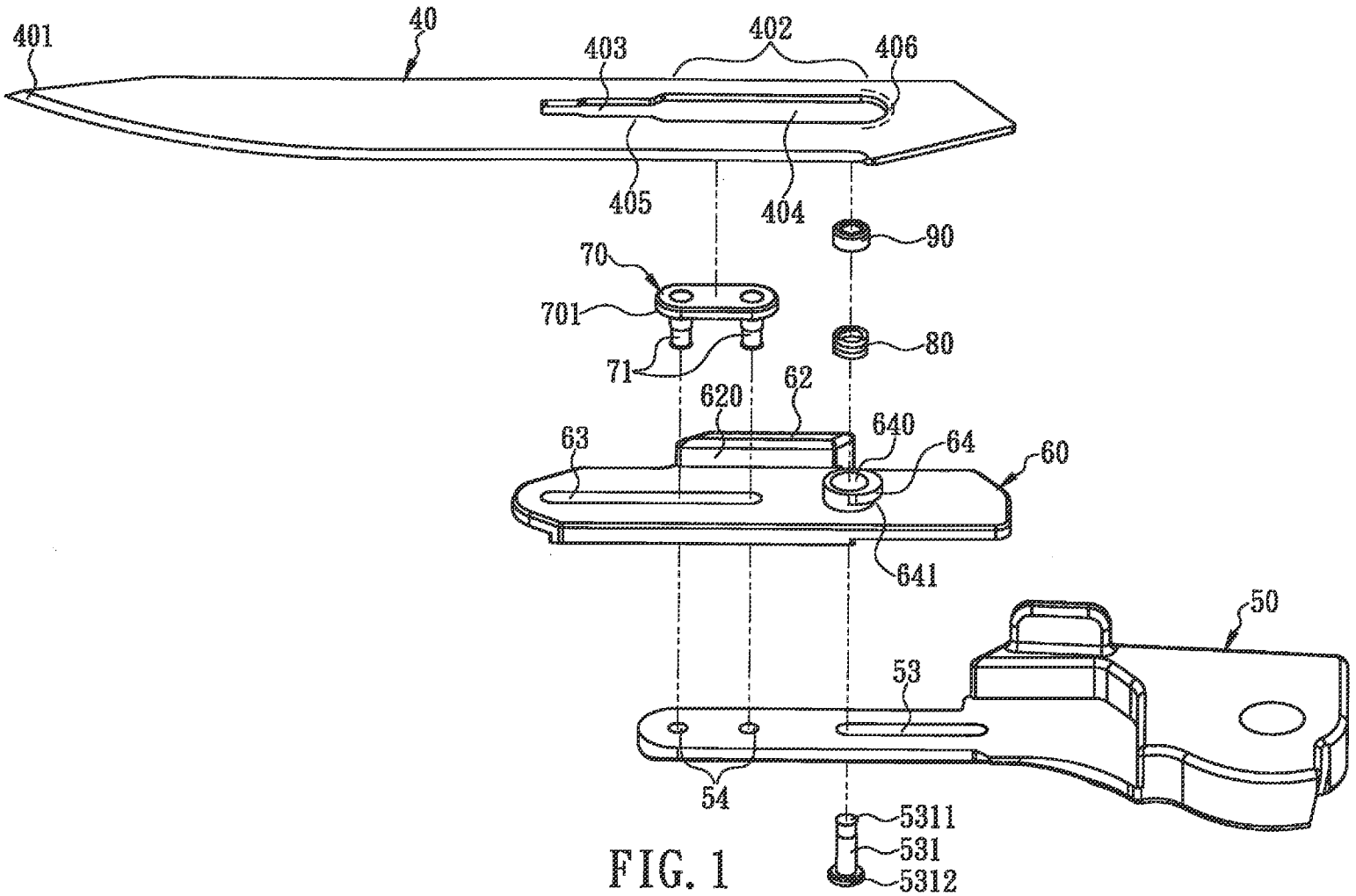
FIG. 1 is an exploded top perspective view of the knife structure according to a preferred embodiment of the invention.

The present invention discloses a knife structure that allows its blade to be rapidly and safely replaced and securely positioned. Also disclosed is the knife handle structure of the knife structure. Referring to FIG. 1 for an exploded top perspective view of the knife structure according to a preferred embodiment of the invention, the knife structure includes a blade 40, an engaging and positioning base 50, an engaging and pushing plate 60, an engaging block 70, a pushing and unlocking key 90, and an elastic element 80. The front end of the blade 40 forms a blade tip 401. The spine of the blade 40 is formed with a first abutting edge 402 adjacent to the rear end of the blade 40. The blade 40 is formed with a first engaging hole 403 and a second engaging hole 404, which are adjacent to the rear end of the blade 40 and are sequentially arranged along the longitudinal direction of the blade 40. The engaging holes 403 and 404 are elongated in shape and are connected to, and therefore in communication with, each other. In this embodiment, the second engaging hole 404 is closer to the rear end of the blade 40 than is the first engaging hole 403, and the first engaging hole 403 has a smaller hole width than the second engaging hole 404 such that the blade 40 is formed with an engaging shoulder 405 at each of two corresponding sides of the first engaging hole 403.

With continued reference to FIG. 1, the top side of the engaging and positioning base 50 is formed with a slide groove 53, which is adjacent to the rear end, and extends along the longitudinal direction, of the engaging and positioning base 50. The slide groove 53 penetrates the engaging and positioning base 50 and opens on the top and bottom sides of the engaging and positioning base 50. A first connecting member 531 extends into the slide groove 53 and can be displaced in the slide groove 53. In this embodiment, a retaining groove 533 (see FIG. 21) is provided in a rear bottom portion of the slide groove 53, and the configuration of the retaining groove 533 matches the configuration of a bottom flange 5312 of the first connecting member 531. When the bottom flange 5312 of the first connecting member 531 is completely exposed on the bottom side of the engaging and positioning base 50, the first connecting member 531 can be displaced forward or rearward along the slide groove 53. Once the bottom flange 5312 of the first connecting member 531 is moved to a position corresponding to the retaining groove 533 and is engaged and retained in the retaining groove 533, the first connecting member 531 enters a locked state and therefore cannot be displaced. In other embodiments of the present invention, the retaining groove 533 and the bottom flange 5312 may be adjusted in design according to product requirements, provided that the bottom flange 5312 of the first connecting member 531 enters the locked state (in which the bottom flange 5312 cannot be displaced forward or rearward along the slide groove 53) upon reaching the rear bottom portion of the slide groove 53. The top end 5311 of the first connecting member 531 extends through the slide groove 53 and is exposed on the top side of the engaging and positioning base 50. The top side of the engaging and positioning base 50 is formed with at least one engaging block fixing hole 54, which is adjacent to the front end, and is arranged along the longitudinal direction, of the engaging and positioning base 50. The engaging block fixing hole 54 also penetrates the engaging and positioning base 50 and opens on the top and bottom sides of the engaging and positioning base 50.

Figure 2:
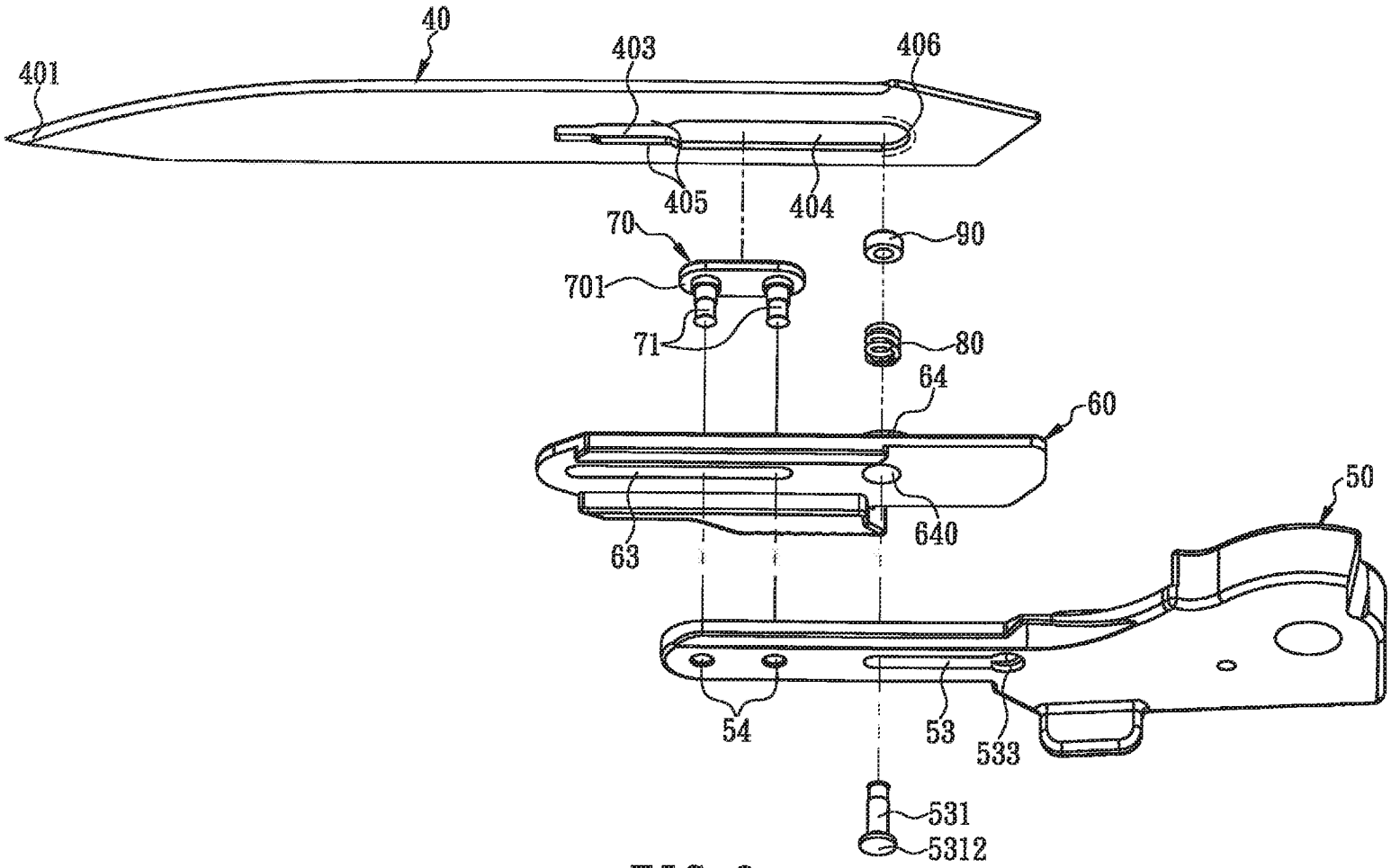
FIG. 2 is an exploded bottom perspective view of the knife structure in FIG. 1.

As shown in FIG. 1 and FIG. 2, the bottom side of the engaging and pushing plate 60 matches the top side of the engaging and positioning base 50 in configuration so that the engaging and pushing plate 60 can be displaced longitudinally forward or rearward on the top side of the engaging and positioning base 50. One lateral edge of the engaging and pushing plate 60 extends upward to form an abutting shoulder 62. The abutting shoulder 62 has a lateral side facing the top side of the engaging and pushing plate 60 and formed with a first abutting surface 620. It should be pointed out that the first abutting surface 620 is provided so that the first abutting edge 402 of the blade 40 can abut against the first abutting surface 620, allowing a user to mount the blade 40 at the corresponding position on the engaging and pushing plate 60 rapidly and conveniently (the mounting process will be detailed further below). In other embodiments of the present invention, however, the abutting shoulder 62 and the related elements may be dispensed with according to practical needs.

With continued reference to FIG. 1 and FIG. 2, the top side of the engaging and pushing plate 60 is formed with a passage groove 63, which is adjacent to the front end, and extends along the longitudinal direction, of the engaging and pushing plate 60. The passage groove 63 penetrates the engaging and pushing plate 60 and opens on the top and bottom sides of the engaging and pushing plate 60. Also, the top side of the engaging and pushing plate 60 is protrudingly provided with a blade pushing structure 64 adjacent to the rear end of the engaging and pushing plate 60. The blade pushing structure 64 is formed therein with a keyhole 640, which penetrates the blade pushing structure 64 and opens on the top and bottom sides of the blade pushing structure 64 so that the top end 5311 of the first connecting member 531 can extend through the keyhole 640 to be exposed on the top side of the blade pushing structure 64. In addition, the blade pushing structure 64 is peripherally provided with a first engaging groove 641. The engaging block 70 matches the second engaging hole 404 in configuration in order to pass through the second engaging hole 404. The engaging block 70 is peripherally provided with a second engaging groove 701, and the bottom side of the engaging block 70 is protrudingly provided with at least one downwardly extending second connecting member 71. There are two second connecting members 71 in the preferred embodiment shown in FIG. 1 and FIG. 2, but there may be only one or more than two second connecting members 71 in other embodiments of the present invention instead. The top end of each second connecting member 71 is fixed to the bottom side of the engaging block 70, while the bottom end of each second connecting member 71 extends through the passage groove 63 and is fixed in the corresponding engaging block fixing hole 54; as a result, the engaging block 70 is fixed at a predetermined position on the engaging and positioning base 50 and will not be displaced along with the engaging and pushing plate 60 when the engaging and pushing plate 60 is moved forward or rearward. Moreover, while the second engaging groove 701 in this preferred embodiment is formed between the periphery of the engaging block 70 and the second connecting members 71, the second engaging groove 701 in other embodiments of the present invention may be configured differently, e.g., concavely provided in the engaging block 70.

Figure 3:
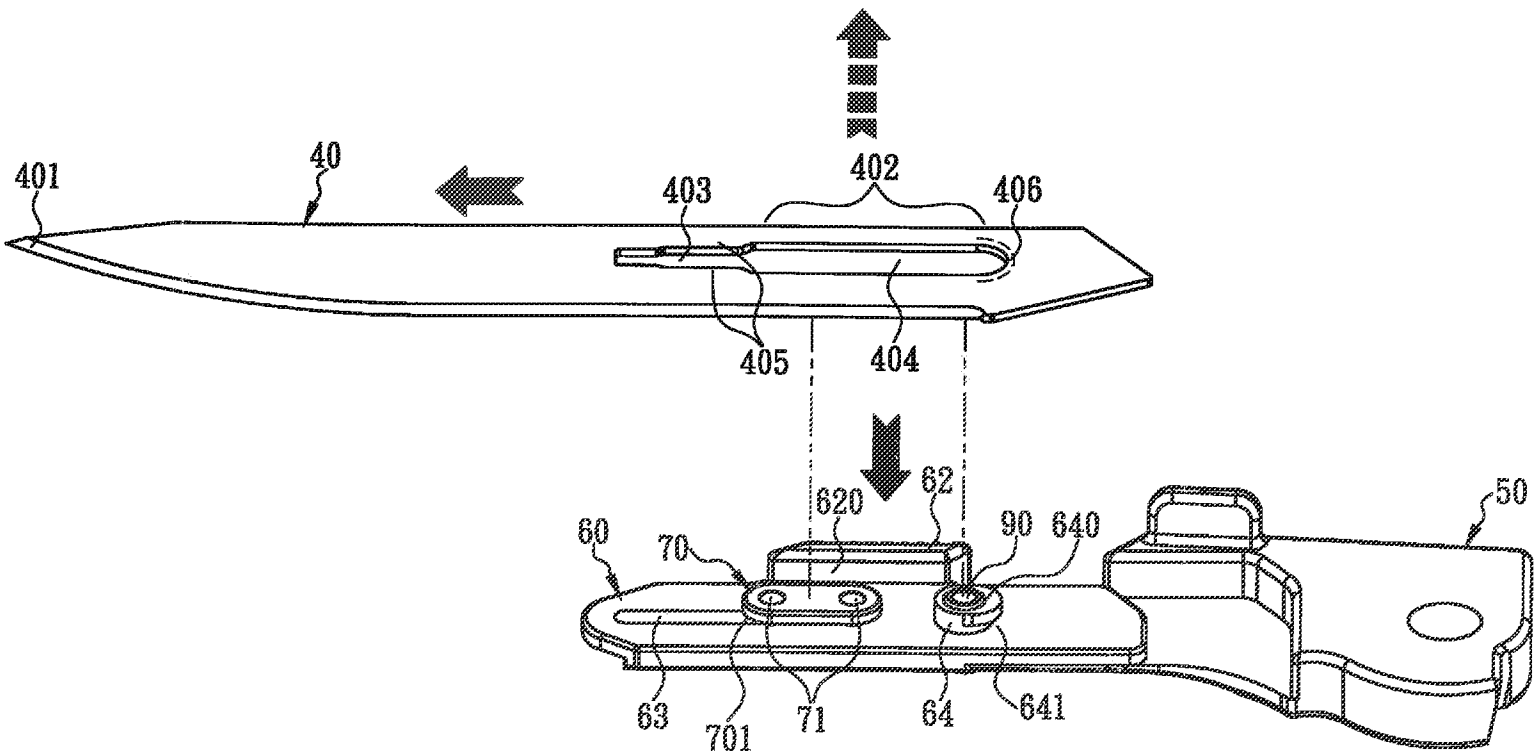
FIG. 3 shows a state of use of the knife structure in FIG. 1.

In this preferred embodiment of the present invention, referring to FIG. 1 and FIG. 2, the pushing and unlocking key 90 is mounted in the keyhole 640 and can be moved downward when pressed and upward when released. The bottom side of the pushing and unlocking key 90 is mounted on the top end 5311 of the first connecting member 531. As shown in FIG. 3, the blade pushing structure 64 and the engaging block 70 jointly form a planar configuration matching the configuration of the second engaging hole 404 and therefore can pass through the second engaging hole 404 simultaneously. Referring back to FIG. 1 and FIG. 2, the elastic element 80 is received in the keyhole 640 and is mounted around the periphery of the first connecting member 531. The bottom end of the elastic element 80 is pressed against the inner wall of the blade pushing structure 64 or a top-side portion of the engaging and positioning base 50 that is adjacent to the slide groove 53. The top end of the elastic element 80 is pressed against the bottom side of the pushing and unlocking key 90 such that the pushing and unlocking key 90 is subjected to the elastic force of the elastic element 80 and has its top side exposed on the top side of the blade pushing structure 64. When a user presses down on the top side of the pushing and unlocking key 90, the bottom flange 5312 of the first connecting member 531 is displaced downward and hence no longer retained in the retaining groove 533 in the rear bottom portion of the slide groove 53 (i.e., released from the locked state); consequently, the first connecting member 531 enters an unlocked state together with the blade pushing structure 64 and the engaging and pushing plate 60. In the unlocked state, the first connecting member 531 can be displaced forward or rearward along the slide groove 53 together with the blade pushing structure 64 and the engaging and pushing plate 60.

Figure 4:
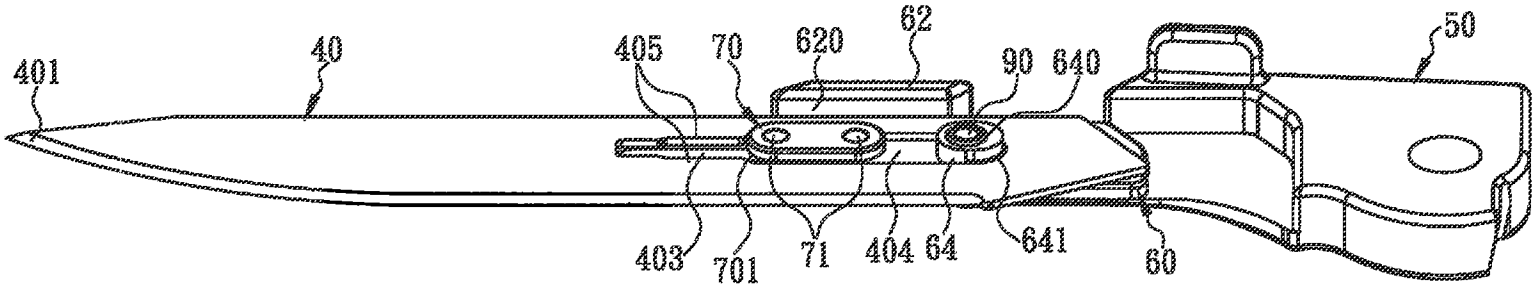
FIG. 4 shows another state of use of the knife structure in FIG. 1.
Figure 5:
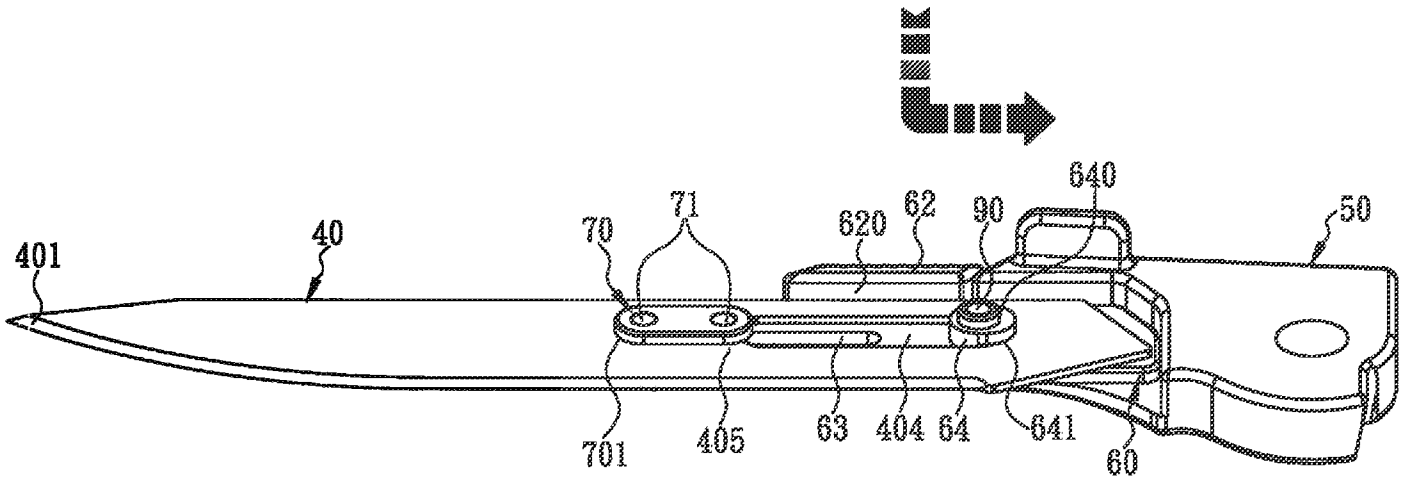
FIG. 5 shows still another state of use of the knife structure in FIG. 1.

Referring again to FIG. 3, when it is desired to mount the blade 40 in place, the user grips the blade 40 gently by its two vertically opposite sides with the fingertips or pulps of two fingers (e.g., a thumb and the corresponding index finger), brings the first abutting edge 402 of the blade 40 into abutment against the first abutting surface 620 of the engaging and pushing plate 60, aligns the second engaging hole 404 of the blade 40 with the blade pushing structure 64 and the engaging block 70 (as indicated by the two vertical dashed lines), and then puts down the blade 40 (as indicated by the bold solid-line downward arrow) in order for the blade pushing structure 64 and the engaging block 70 to pass through the second engaging hole 404 simultaneously until the bottom side of the blade 40 lies against the top side of the engaging and pushing plate 60, as shown in FIG. 4. After that, referring to FIG. 5, the user presses down the pushing and unlocking key 90 with the tip of a finger (e.g., a thumb) (as indicated by the vertical section of the bold dashed-line arrow) and pushes the blade pushing structure 64 rearward with the same finger (as indicated by the horizontal section of the bold dashed-line arrow) such that the engaging and pushing plate 60 is displaced rearward together with the blade 40, which now lies on the top side of the engaging and pushing plate 60. Once displaced back to the retaining groove 533 in the rear bottom portion of the slide groove 53, referring to FIG. 2, the bottom flange 5312 of the first connecting member 531 is automatically driven into engagement in the retaining groove 533 by the elastic restoring force of the elastic element 80 and hence enters the locked state, in which the bottom flange 5312 cannot be moved forward along the slide groove 53. In the same locked state, referring back to FIG. 5, the second engaging groove 701 of the engaging block 70 is engaged with the engaging shoulders 405, and the first engaging groove 641 of the blade pushing structure 64 is engaged with an engaging portion 406 of the blade 40 that corresponds in position to the rear edge of the second engaging hole 404. Thus, the blade 40 is easily, safely, and securely coupled to the engaging and pushing plate 60 and is in a locked state in which the blade 40 is inseparable from the engaging and pushing plate 60, allowing the user to use the blade 40 safely.

Figure 6:
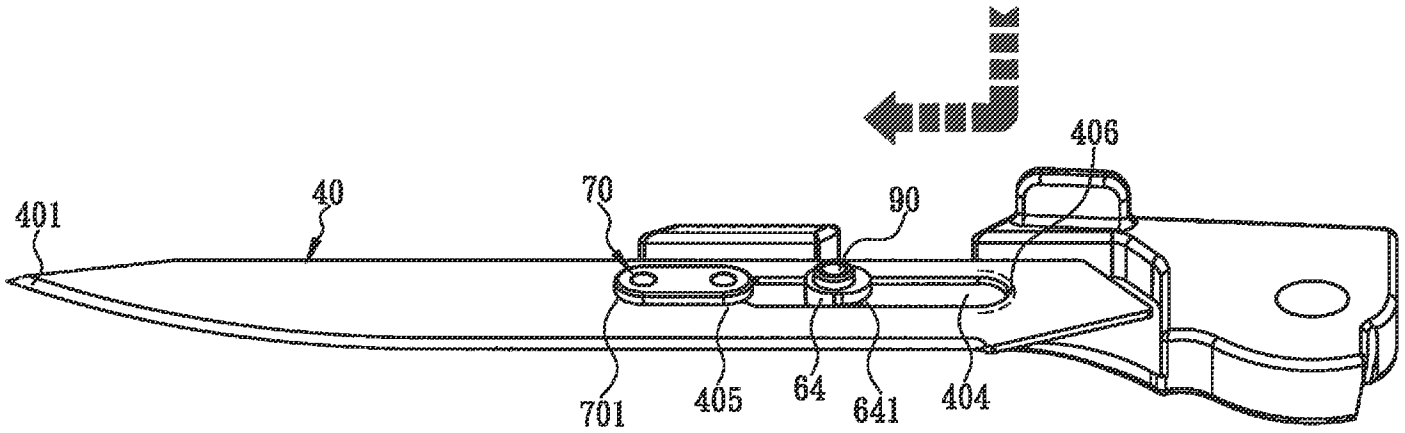
FIG. 6 shows yet another state of use of the knife structure in FIG. 1.

Conversely, when it is desired to detach the blade 40 from the knife structure, referring to FIG. 6, the user presses down on the top side of the pushing and unlocking key 90 with the tip of a finger (e.g., a thumb) (as indicated by the vertical section of the bold dashed-line arrow) such that, referring to FIG. 2, the bottom flange 5312 of the first connecting member 531 is displaced downward and brought out of the locked state (i.e., no longer retained in the rear bottom portion of the slide groove 53). The first connecting member 531, therefore, enters the unlocked state along with the blade pushing structure 64 and the engaging and pushing plate 60 and can be displaced forward together with the blade pushing structure 64 and the engaging and pushing plate 60. In this state, referring back to FIG. 6, the user only has to push the blade pushing structure 64 forward with the tip of the same finger (e.g., the same thumb) (as indicated by the horizontal section of the bold dashed-line arrow), and the first engaging groove 641 of the blade pushing structure 64 will be disengaged from the engaging portion 406 of the blade 40. After that, referring back to FIG. 3, the user only has to grip the blade 40 gently by its two vertically opposite sides with the fingertips or pulps of two fingers (e.g., a thumb and the corresponding index finger) and move the blade 40 forward (as indicated by the bold solid-line leftward arrow), and the engaging shoulders 405 of the blade 40 will be disengaged from the second engaging groove 701 of the engaging block 70, allowing the blade 40 to be easily and safely detached from the engaging and pushing plate 60 (as indicated by the bold dashed-line upward arrow).

According to the above, whether it is desired to mount the blade 40 to the engaging and pushing plate 60 or detach the blade 40 from the engaging and pushing plate 60, all the user has to do is press down the pushing and unlocking key 90 with a finger and push the blade pushing structure 64 rearward or forward with the same finger to bring the blade 40 into either the locked state, in which the blade 40 cannot be separated from the engaging and pushing plate 60, or the unlocked state, in which the blade 40 can be rapidly detached from the engaging and pushing plate 60. It is totally unnecessary for the user to grip the blade 40 between fingers and apply to the blade 40 a force large enough to deform the blade 40. The knife structure disclosed herein not only allows user to complete the mounting, dismounting, or replacing process of the blade 40 easily, rapidly, and safely, but also ensures that the blade 40 stays securely positioned in the locked state (i.e., inseparable from the engaging and pushing plate 60) when the user is trying to cut an object with the blade 40 by applying a force to the blade 40; in other words, safe and steady use of the knife structure is ensured.

Figure 7:
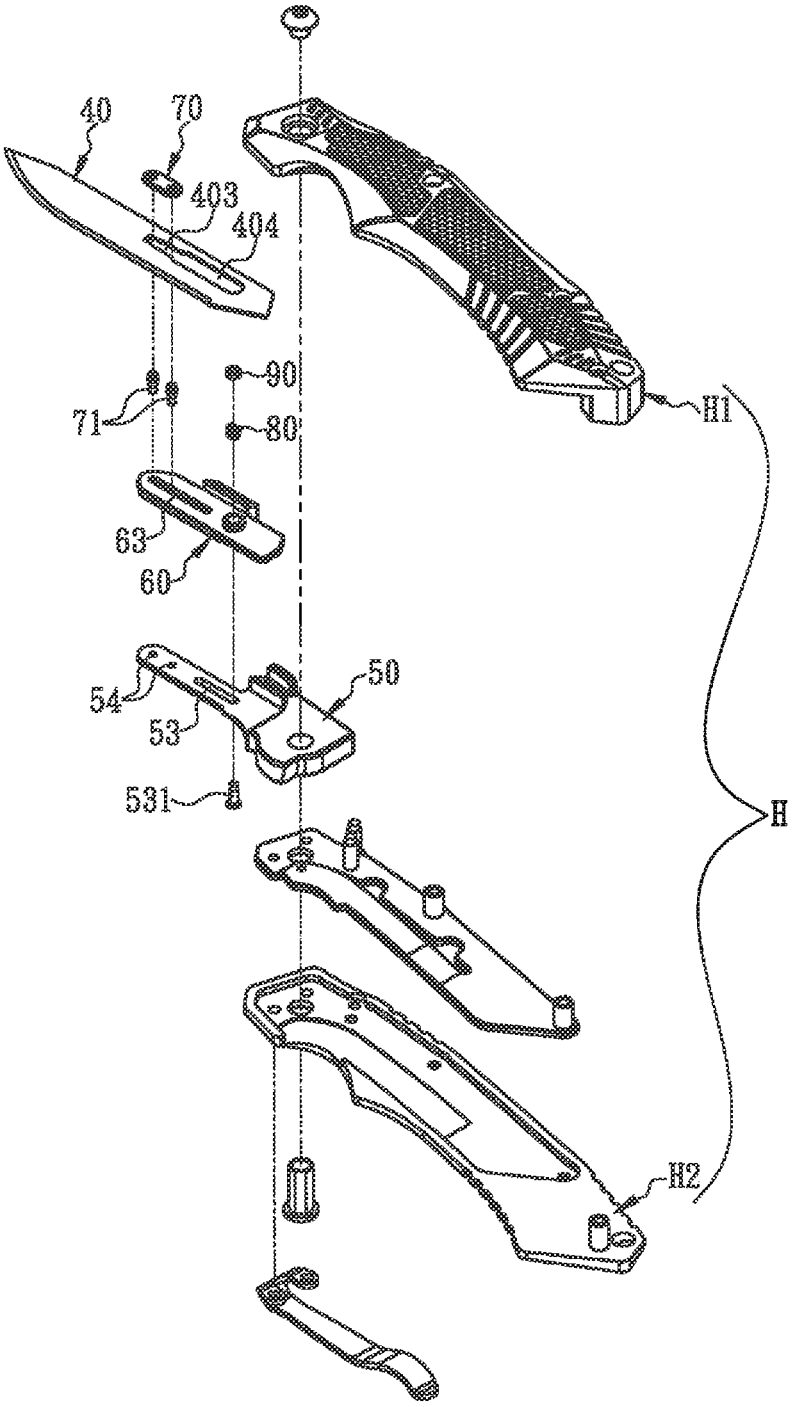
FIG. 7 is an exploded perspective view of the knife structure according to another preferred embodiment of the invention.
Figure 8:
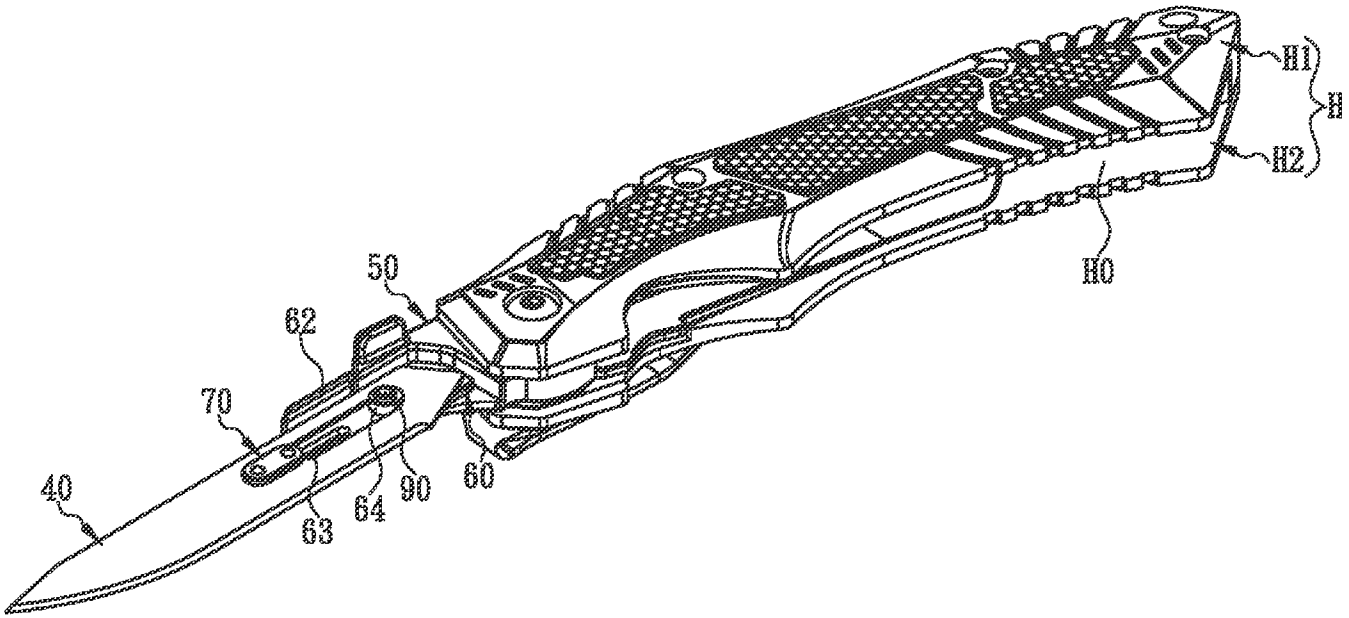
FIG. 8 is an assembled perspective view of the knife structure in FIG. 7.

In the embodiment described above, referring to FIG. 7, the knife structure further includes a handle H. The handle H has one end fixedly connected to one end of the engaging and positioning base 50, and is configured to match the shape of a user's palm so as to be gripped therein. In another preferred embodiment of the present invention, with continued reference to FIG. 7, the knife structure further includes an upper handle portion H1 and a lower handle portion H2, wherein the upper handle portion H1 and the lower handle portion H2 jointly form the handle H. Referring to FIG. 8, the upper handle portion H1 and the lower handle portion H2 also form a receiving space H0 therebetween. The front end of the handle H is pivotally connected to the rear end of the engaging and positioning base 50 so that the engaging and positioning base 50, the engaging and pushing plate 60, and the blade 40 engaged with and positioned on the engaging and pushing plate 60 can rotate with respect to the handle H either into or out of the receiving space H0 of the handle H, turning the disclosed knife structure into a folding knife.

The foregoing embodiments are only some preferred ones of the present invention. It is worth mentioning that the invention can be implemented in such a way that the handle, the engaging and positioning base, and the pushing and unlocking key are designed to form a single unit, or a knife handle structure, allowing a user to buy blades 40 of different specifications and functions as needed and, when a particular blade 40 is called for, to carry out the required blade mounting, dismounting, or replacing process on the knife handle structure easily, rapidly, and safely. The technical features of the present invention, therefore, are not limited to those described above. All changes that are readily conceivable by a person of ordinary skill in the art who has knowledge of the technical contents disclosed herein should fall within the scope of patent protection sought by the applicant.

What is claimed is:

1. A knife structure allowing rapid and safe replacement, and secure positioning, of a blade, comprising:

the blade, wherein the blade has a front end formed with a blade tip; the blade is formed with a first engaging hole section and a second engaging hole section arranged sequentially along a longitudinal direction of the blade at positions adjacent to a rear end of the blade; the engaging hole sections are elongated in shape and are connected, and hence in communication, with each other; the second engaging hole section is closer to the rear end of the blade than is the first engaging hole section; and the first engaging hole section has a smaller hole width than the second engaging hole section such that the blade is formed with an engaging shoulder at each of two corresponding sides of the first engaging hole section;

an engaging and positioning base having a top side formed with a slide groove, wherein the slide groove is adjacent to a rear end, and extends along a longitudinal direction, of the engaging and positioning base; the slide groove penetrates the engaging and positioning base and opens on the top side and a bottom side of the engaging and positioning base; the slide groove is provided therein with a first connecting member; the first connecting member has a bottom flange exposed on the bottom side of the engaging and positioning base; the first connecting member is configured to be displaced forward or rearward along the slide groove or have the bottom flange retained in a rear bottom portion of the slide groove such that the bottom flange enters a locked state and is unable to be displaced along the slide groove; and the first connecting member has atop end extending through the slide groove and exposed on the top side of the engaging and positioning base;

an engaging and pushing plate having a bottom side matching the top side of the engaging and positioning base in configuration such that the engaging and pushing plate is able to be displaced forward or rearward along a longitudinal direction thereof on the top side of the engaging and positioning base; the engaging and pushing plate has a top side formed with a passage groove; the passage groove is adjacent to a front end, and extends along the longitudinal direction, of the engaging and pushing plate; the passage groove penetrates the engaging and pushing plate and opens on the top side and the bottom side of the engaging and pushing plate; the top side of the engaging and pushing plate is protrudingly provided with a blade pushing structure adjacent to a rear end of the engaging and pushing plate; the blade pushing structure is formed therein with a keyhole; the keyhole penetrates the blade pushing structure and opens on a top side and a bottom side of the blade pushing structure in order for the top end of the first connecting member to extend through the keyhole and be exposed on the top side of the blade pushing structure; and the blade pushing structure has a periphery concavely provided with a first engaging groove;

an engaging block matching the second engaging hole section in configuration in order for the engaging block and the blade pushing structure to extend through the second engaging hole section simultaneously, wherein the engaging block has a periphery provided with a second engaging groove, the engaging block has a bottom side protrudingly provided with at least one downwardly extending second connecting member, and the second connecting member has a bottom end extending through the passage groove and fixed to the engaging and positioning base such that the engaging block is not displaced along with the engaging and pushing plate when the engaging and pushing plate is moved forward or rearward; a pushing and unlocking key movably mounted in the keyhole, wherein the pushing and unlocking key has a bottom side mounted on the top end of the first connecting member; and an elastic element received in the keyhole and mounted around a periphery of the first connecting member, wherein the elastic element has a bottom end pressed against an inner wall of the blade pushing structure or a top-side portion of the engaging and positioning base that is adjacent to the slide groove, and the elastic element has a top end pressed against the bottom side of the pushing and unlocking key in order for a top side of the pushing and unlocking key to be exposed on the top side of the blade pushing structure;

wherein the blade is mounted in place by: aligning the second engaging hole section of the blade with the blade pushing structure and the engaging block; putting the blade down in order for the blade pushing structure and the engaging block to extend through the second engaging hole section simultaneously, and for a bottom side of the blade to lie against the top side of the engaging and pushing plate; pressing down on the top side of the pushing and unlocking key such that the first connecting member, together with the blade pushing structure and the engaging and pushing plate, enters an unlocked state and is hence movable; and pushing the blade pushing structure rearward such that the engaging and pushing plate is displaced rearward together with the blade on the top side of the engaging and pushing plate until the bottom flange of the first connecting member reaches and is retained in the rear bottom portion of the slide groove and thus enters a locked state, in which the bottom flange is unable to be moved forward or rearward along the slide groove, and in which the second engaging groove of the engaging block and the first engaging groove of the blade pushing structure are respectively engaged with the engaging shoulders and an engaging portion of the blade that corresponds in position to a rear edge of the second engaging hole section such that the blade is securely coupled to the engaging and pushing plate and enters a locked state, in which the blade is inseparable from the engaging and pushing plate;

wherein the blade is detached from the knife structure by: pressing down on the top side of the pushing and unlocking key such that the bottom flange of the first connecting member is displaced downward and thereby brought out of the locked state of the bottom flange, i.e., no longer retained in the rear bottom portion of the slide groove, bringing the first connecting member, together with the blade pushing structure and the engaging and pushing plate, into the unlocked state, in which the first connecting member is allowed to be displaced forward or rearward together with the blade pushing structure and the engaging and pushing plate; pushing the blade pushing structure forward such that the first engaging groove concavely provided in the periphery of the blade pushing structure is disengaged from the engaging portion of the blade that corresponds in position to the rear edge of the second engaging hole section; and moving the blade forward such that the engaging shoulders of the blade are disengaged from the first engaging groove of the engaging block, allowing the blade to be detached from the engaging and pushing plate.

2. The knife structure of claim 1, wherein the blade has a spine formed with a first abutting edge adjacent to the rear end of the blade, the engaging and pushing plate has a lateral edge formed with an upwardly extending abutting shoulder, the abutting shoulder has a lateral side facing the top side of the engaging and pushing plate and formed with a first abutting surface, and the first abutting edge of the blade is brought into abutment against the first abutting surface of the engaging and pushing plate when the blade is being mounted in place.

3. The knife structure of claim 2, further comprising a handle, wherein the handle has a front end fixedly connected to the rear end of the engaging and positioning base, and the handle matches a user's palm in configuration so as to be gripped in the user's palm.

4. The knife structure of claim 2, further comprising an upper handle portion and a lower handle portion, wherein the upper handle portion and the lower handle portion jointly form a handle, the upper handle portion and the lower handle portion also form a receiving space therebetween, and the handle has an end pivotally connected to the rear end of the engaging and positioning base such that the engaging and positioning base, the engaging and pushing plate, and the blade engaged with and positioned on the engaging and pushing plate are rotatable with respect to the handle either into or out of the receiving space of the handle, thus turning the knife structure into a folding knife.

5. The knife structure of claim 1, further comprising a handle, wherein the handle has a front end fixedly connected to the rear end of the engaging and positioning base.

6. The knife structure of claim 1, further comprising an upper handle portion and a lower handle portion, wherein the upper handle portion and the lower handle portion jointly form a handle, the upper handle portion and the lower handle portion also form a receiving space therebetween, and the handle has an end pivotally connected to the rear end of the engaging and positioning base such that the engaging and positioning base, the engaging and pushing plate, and the blade engaged with and positioned on the engaging and pushing plate are rotatable with respect to the handle either into or out of the receiving space of the handle, thus turning the knife structure into a folding knife.

7. A knife handle structure allowing rapid and safe replacement, and secure positioning, of a blade, wherein the knife handle structure and the blade are assembled together; the blade is formed with a first engaging hole section and a second engaging hole section arranged sequentially along a longitudinal direction of the blade; the engaging hole section are connected, and hence in communication, with each other; and the first engaging hole section has a smaller hole width than the second engaging hole section such that the blade is formed with an engaging shoulder at each of two corresponding sides of the first engaging hole section, the knife handle structure comprising:

a handle;

an engaging and positioning base having a rear end fixedly connected to a front end of the handle, wherein the engaging and positioning base has a top side formed with a slide groove; the slide groove is adjacent to the rear end, and extends along a longitudinal direction, of the engaging and positioning base; the slide groove penetrates the engaging and positioning base and opens on the top side and a bottom side of the engaging and positioning base; the slide groove is provided therein with a first connecting member; the first connecting member has a bottom flange exposed on the bottom side of the engaging and positioning base; the first connecting member is configured to be displaced forward or rearward along the slide groove or have the bottom flange retained in a rear bottom portion of the slide groove such that the bottom flange enters a locked state and is unable to be displaced forward or rearward along the slide groove; and the first connecting member has a top end extending through the slide groove and exposed on the top side of the engaging and positioning base;

an engaging and pushing plate having a bottom side matching the top side of the engaging and positioning base in configuration such that the engaging and pushing plate is able to be displaced forward or rearward along a longitudinal direction thereof on the top side of the engaging and positioning base; the engaging and pushing plate has a top side formed with a passage groove; the passage groove is adjacent to a front end, and extends along the longitudinal direction, of the engaging and pushing plate; the passage groove penetrates the engaging and pushing plate and opens on the top side and the bottom side of the engaging and pushing plate; the top side of the engaging and pushing plate is protrudingly provided with a blade pushing structure adjacent to a rear end of the engaging and pushing plate; the blade pushing structure is formed therein with a keyhole; the keyhole penetrates the blade pushing structure and opens on a top side and a bottom side of the blade pushing structure in order for the top end of the first connecting member to extend through the keyhole and be exposed on the top side of the blade pushing structure; and the blade pushing structure has a periphery concavely provided with a first engaging groove;

an engaging block matching the second engaging hole section in configuration in order for the engaging block and the blade pushing structure to extend through the second engaging hole section simultaneously, wherein the engaging block has a periphery provided with a second engaging groove, the engaging block has a bottom side protrudingly provided with at least one downwardly extending second connecting member, and the second connecting member has a bottom end extending through the passage groove and fixed to the engaging and positioning base such that the engaging block is not displaced along with the engaging and pushing plate when the engaging and pushing plate is moved forward or rearward;

a pushing and unlocking key movably mounted in the keyhole, wherein the pushing and unlocking key has a bottom side mounted on the top end of the first connecting member; and an elastic element received in the key hole and mounted around a periphery' of the first connecting member, wherein the elastic element has a bottom end pressed against an inner wall of the blade pushing structure or a top-side portion of the engaging and positioning base that is adjacent to the slide groove; the elastic element has a top end pressed against the bottom side of the pushing and unlocking key in order for a top side of the pushing and unlocking key to be exposed on the top side of the blade pushing structure; and when the user presses down on the top side of the pushing and unlocking key with a finger, the bottom flange of the first connecting member is displaced downward and thereby brought out of the locked state, i.e., no longer retained in the rear bottom portion of the slide groove, bringing the first connecting member, together with the blade pushing structure and the engaging and pushing plate, into an unlocked state, in which the first connecting member is allowed to be displaced forward or rearward along the slide groove together with the blade pushing structure and the engaging and pushing plate.

8. The knife handle structure of claim 7, wherein the engaging and pushing plate has a lateral edge formed with an upwardly extending abutting shoulder, the abutting shoulder has a lateral side facing the top side of the engaging and pushing plate and formed with a first abutting surface, the blade has a spine formed with a first abutting edge adjacent to the rear end of the blade, and the first abutting edge is brought into abutment against the first abutting surface of the engaging and pushing plate when the blade is being mounted in place.

9. The knife handle structure of claim 8, wherein the handle is composed of an upper handle portion and a lower handle portion, the upper handle portion and the lower handle portion form a receiving space therebetween, and the engaging and positioning base and the blade engaged with and positioned on the engaging and positioning base are rotatable with respect to the handle either into or out of the receiving space of the handle.

10. The knife handle structure of claim 7, wherein the handle is composed of an upper handle portion and a lower handle portion, the upper handle portion and the lower handle portion form a receiving space therebetween, and the engaging and positioning base and the blade engaged with and positioned on the engaging and positioning base are rotatable with respect to the handle either into or out of the receiving space of the handle.

* * * * *